US011258206B2

(12) United States Patent
He et al.

(10) Patent No.: US 11,258,206 B2
(45) Date of Patent: Feb. 22, 2022

(54) TERMINAL ASSEMBLY

(71) Applicant: Dongguan Luxshare Technologies Co., Ltd, Dongguan (CN)

(72) Inventors: YunFeng He, Dongguan (CN); HongJi Chen, Dongguan (CN); HaoHan Chen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 16/987,954

(22) Filed: Aug. 7, 2020

(65) Prior Publication Data

US 2021/0265783 A1 Aug. 26, 2021

(30) Foreign Application Priority Data

Feb. 25, 2020 (CN) ..... 202010115231.2

(51) Int. Cl.

| | |
|---|---|
| ***H01R 13/648*** | (2006.01) |
| ***H01R 13/6471*** | (2011.01) |
| ***H01R 12/55*** | (2011.01) |
| ***H01R 12/71*** | (2011.01) |
| ***H01R 13/6586*** | (2011.01) |

(52) U.S. Cl.

CPC ..... *H01R 13/6471* (2013.01); *H01R 12/55* (2013.01); *H01R 12/71* (2013.01); *H01R 13/6586* (2013.01)

(58) Field of Classification Search

CPC ..... H01R 13/6471; H01R 13/6586; H01R 12/55; H01R 12/71

USPC ..... 439/108

See application file for complete search history.

(56) References Cited

U.S. PATENT DOCUMENTS

| | | | |
|---|---|---|---|
| 8,523,583 | B2 | 9/2013 | Ito |
| 8,545,240 | B2 | 10/2013 | Casher et al. |
| 2019/0296469 | A1 | 9/2019 | Stokoe et al. |

FOREIGN PATENT DOCUMENTS

| | | | |
|---|---|---|---|
| CN | 208862209 | U | 5/2019 |
| CN | 209088169 | U | 7/2019 |
| CN | 110098510 | A | 8/2019 |
| CN | 110247233 | A | 9/2019 |

*Primary Examiner* — Khiem M Nguyen

(74) *Attorney, Agent, or Firm* — Birch, Stewart, Kolasch & Birch, LLP

(57) ABSTRACT

The present disclosure disclosed a terminal assembly comprising a first terminal module and an electric conductive part. The first terminal module comprises a plurality of first ground terminals and a plurality of first signal terminals. At least one first signal terminal is provided between two adjacent first ground terminals. The electric conductive part is disposed on the first terminal module. The first signal terminal is closer to a surface of the electric conductive part than the first ground terminal. The electric conductive part is distancing from both the first signal terminal and the first ground terminal while the first signal terminals are closer to the electric conductive part than the first ground terminals, the electric conductive part and the ground terminal could surround the first signal terminal.

12 Claims, 3 Drawing Sheets

TERMINAL ASSEMBLY

CROSS REFERENCE TO RELATED APPLICATION

This application claims the priority benefit of Chinese Patent Application Serial Number CN202010115231.2, filed on Feb. 25, 2020, the full disclosure of which is incorporated herein by reference.

BACKGROUND

Technical Field

The present disclosure relates to the technical field of electrical connector, particularly to a terminal assembly for preventing crosstalk.

Related Art

For connectors that transmit high-frequency signals, preventing crosstalk between high-frequency signal terminals has always been an important technical issue. When a signal terminal transmits a signal, an electromagnetic wave is generated. When the electromagnetic wave is absorbed by the adjacent signal terminals, the signal in the adjacent signal terminals would be affected. Therefore, solutions are proposed to solve the problem of crosstalk or resonance between signal terminals.

SUMMARY

The embodiments of the present disclosure provide a terminal assembly to solve the problems of crosstalk between signal terminals.

The present disclosure provides a terminal assembly comprising a first terminal module and an electric conductive part. The first terminal module comprises a plurality of first ground terminals and a plurality of first signal terminals. At least one first signal terminal is provided between two adjacent first ground terminals. The electric conductive part is disposed on the first terminal module. The plurality of first signal terminals is closer to a surface of the electric conductive part than the plurality of first ground terminals, and the electric conductive part is close to but not contact with the first signal terminals of the first terminal module.

In the embodiments of the present disclosure, by distancing the conductive part from the first signal terminal and the first ground terminal while the first signal terminals are closer to the electric conductive part than the first ground terminals, the electric conductive part and the ground terminal could surround the first signal terminal, so that most of the electromagnetic waves generated by the first signal terminal are absorbed or shielded by the electric conductive part to reduce resonance or crosstalk between the signal terminals.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
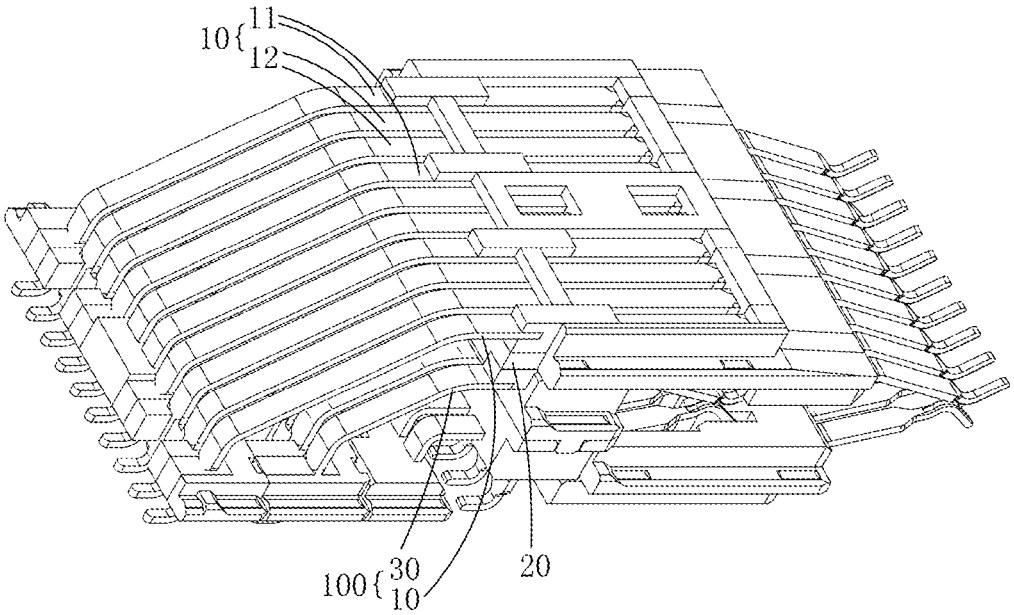
FIG. 1 is a perspective view of a terminal assembly of one embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the disclosure.

Figure 2:
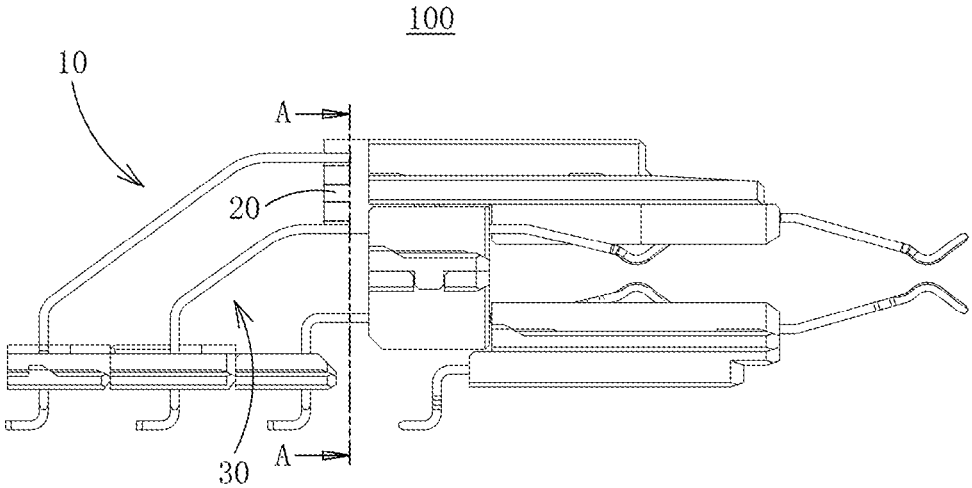
FIG. 2 is a front view of the terminal assembly of one embodiment of the present disclosure.
Figure 3:
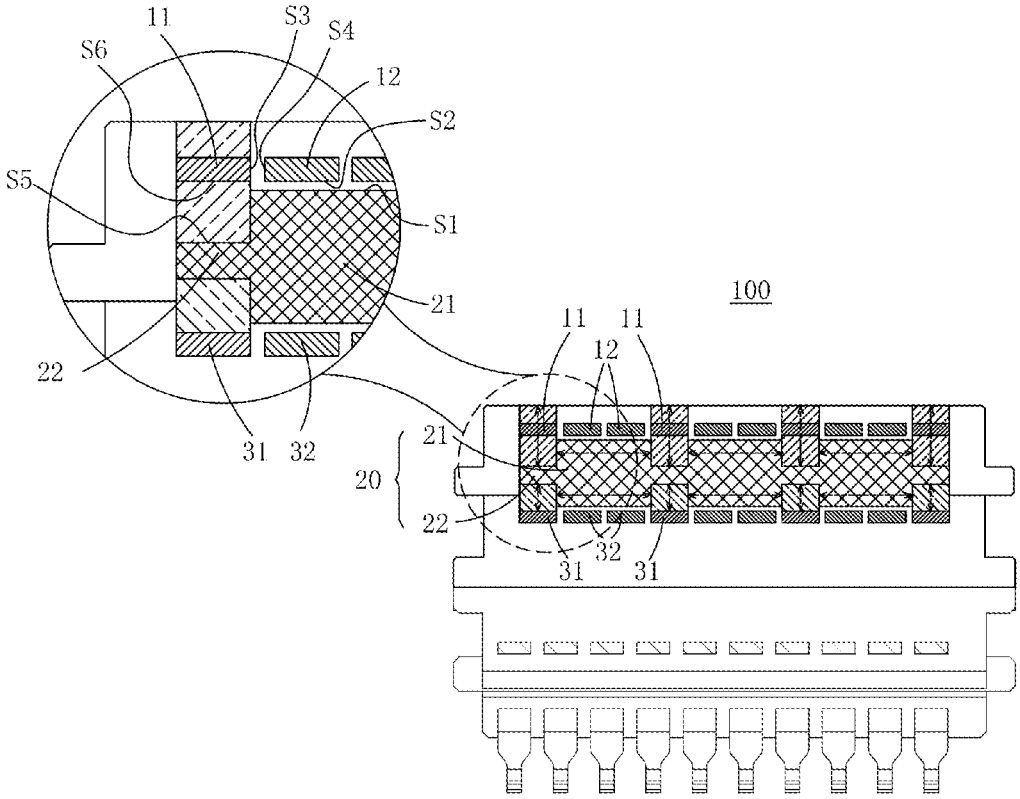
FIG. 3 is a cross-sectional view of the terminal assembly in FIG. 2 along line A-A.

FIG. 1 and FIG. 2 are perspective view and front view of a terminal assembly of one embodiment of the present disclosure. FIG. 3 is a cross-sectional view of the terminal assembly in FIG. 2 along line A-A. As shown in the figures, the present disclosure provides a terminal assembly 100 comprising a first terminal module 10 and an electric conductive part 20. The first terminal module 10 comprises a plurality of first ground terminals 11 and a plurality of first signal terminals 12. At least one first signal terminal 12 is provided between two adjacent first ground terminals 11. The electric conductive part 20 is disposed on the first terminal module 10. The plurality of first signal terminals 12 is closer to a surface S1 of the electric conductive part 20 than the plurality of first ground terminals. The first signal terminals 12 and the first ground terminals 11 are both not contacting with the electric conductive part 20.

Because the first signal terminals 12 and the first ground terminals 11 are both not contacting with the electric conductive part 20, and because the electric conductive part 20 is closer to the first signal terminals 12 than the first ground terminals 11, the electromagnetic waves would be absorbed or shielded by the electric conductive part 20 which is in a closer position when first signal terminal 12 transmits a high-frequency signal. In addition, the electric potential change after the electromagnetic wave is absorbed or shielded would not affect the first ground terminal as there is no contacting between the electric conductive part 20 and the first ground terminals 11.

As shown in FIG. 3, two first signal terminals 12 are provided between two adjacent first ground terminals 11. In this embodiment, the two first signal terminals 12 are parallelly disposed adjacent to each other. The two first ground terminals 11 are also parallelly disposed. Two first signal terminals 12 are provided between two first ground terminals 11. Moreover, the two first ground terminals 11 and the two first signal terminals 12 are also parallelly disposed in a row. The electric conductive part 20 is disposed on one side of the two first signal terminals 12. The electric conductive part 20 is disposed below the two first signal terminals 12 and surrounds the two first signal terminals 12 with the two first ground terminals 11 to shield the two first signal terminals 12. However, the electric conductive part 20 does not contact both the first signal terminals 12 and the first ground terminals 11.

In this embodiment, a surface S1 of the electric conductive part 20 is the surface closest to the two first signal terminals 12 among all the surfaces of the electric conductive part 20. The surface S1 of the electric conductive part 20 and a surface S2 of the first signal terminal 12 are parallel and are oppositely disposed. A surface S3 of the first ground terminal 11 is the surface of the first ground terminal 11 closest to the first signal terminal 12. In this embodiment, the surface S3 of the first ground terminal 11 is parallel to and is opposite to another surface S4 of the first signal terminal 12. By configuring the distance between the surface S1 and the surface S2 being smaller than the distance between the surface S3 and the surface S4, the electric conductive part 20 is closer to the first signal terminal 12 than the first ground terminal 11.

The terminal assembly 100 of this embodiment comprises a plurality pairs of first signal terminals 12. One first ground terminal 11 is provided between the two pairs of first signal terminals 12. For example, the terminal 100 shown in FIG. 3 includes three pairs of first signal terminals 12. One first ground terminal 11 is provided between the two pairs of first signal terminals 12. One first ground terminal 11 is also provided at the outside of the outermost pair of first signal terminals 12. Providing the first ground terminal 11 between the two pairs of first signal terminals 12 could have an effect of shielding to prevent crosstalk between two adjacent pairs of first signal terminals 12.

The terminal assembly 100 of this embodiment further comprises a second terminal module 30 comprising a plurality of second ground terminals 31 and a plurality of second signal terminals 32. At least one second signal terminal 32 is provided between two adjacent second ground terminals 31. The second terminal module 30 is disposed on the first terminal module 10. The plurality of second ground terminals 31 opposites to the plurality of first ground terminals 11. The plurality of second signal terminals 32 opposites to the plurality of first signal terminals 12. The electric conductive part 20 is disposed between the first terminal module 10 and the second terminal module 30. The second signal terminal 32 is closer to a surface of the electric conductive part 20 close to the second terminal module 30 than the second ground terminal 31. Both the second signal terminal 32 and the second ground terminal 31 are distant from the electric conductive part 20.

The electric conductive part 20 comprises a plurality of first electric conductors 21 disposed at intervals. Each first electric conductor 21 is disposed between at least one first signal terminal 12 and at least one second signal terminal 32 opposite to the first signal terminals 12. The first ground terminal 11 and second ground terminal 31 opposite to the first ground terminal 11 correspond to the interval space between two adjacent first electric conductors 21. In this embodiment, the first electric conductor 21 is a rectangular parallelepiped, and the first electric conductors 21 is disposed at the third and fourth quadrants of the first signal terminal 12. The aforementioned surface S1 is a surface of the first electric conductor 21. The surface S1 corresponds to two first signal terminals 12. A gap is formed between two adjacent first electric conductors 21. The first ground terminal 11 corresponds to the interval space between two adjacent first electric conductors 21.

The electric conductive part 20 further comprises a plurality of second electric conductors 22. Two ends of the at least one second electric conductor 22 are connected to two adjacent first electric conductors 21. Each second electric conductor 22 is disposed opposite to the first ground terminal 11. The second electric conductor 22 is used to connect each first electric conductor 21. The distance between the surface of the second electric conductor 22 close to the first ground terminal 11 and the first ground terminal 11 is greater than the distance between the surface of the first electric conductor 21 close to the first signal terminal 12 and the first signal terminal 12. As shown in FIG. 3, the second electric conductor 22 is also a rectangular parallelepiped. However, the width and height of the second electric conductor 22 are smaller than that of the first electric conductor 21. Since the second electric conductor 22 is connected to the center position of a side of the first electric conductor 21, the joint of the second electric conductor 22 and the first electric conductor 21 forms a stepped connection. A surface S5 of the second electric conductor 22 is opposite to a surface S6 of the first ground terminal 11. The surface S5 of the second electric conductor 22 is the surface closest to the first ground terminal 11 among all surfaces of the second electric conductor 22. As shown in FIG. 3, the distance between the surface S5 of the second electric conductor 22 and the surface S6 of the first ground terminal 11 is smaller than the distance between the surface S1 of the electric conductive part 20 and the surface S2 of the first signal terminal 12.

As shown in FIG. 3, the electric conductive part 20 is disposed between the first terminal module 10 and the second terminal module 30. In detail, the first electric conductor 21 is disposed between the first signal terminals 12 and the second signal terminals 32, and the second electric conductor 22 is disposed between the first ground terminals 11 and the second ground terminals 31. Thus, the first electric conductor 21 of the electric conductive part 20 could perform shielding or wave absorption between the first signal terminal 12 and the second signal terminal 32, preventing signal crosstalk between the first signal terminal 12 and the second signal terminal 32. In addition to connecting the first electric conductor 21, the second electric conductor 22 also performs the effect of enhancing the above-mentioned shielding or wave absorption. As pointed out by the arrow in FIG. 3, the electric conductive part 20, the first ground terminal 11, and the second ground terminal 31 surround the first signal terminal 12 and the second signal terminal 32. In this way, crosstalk between adjacent first signal terminals 12, adjacent second signal terminals 32, and between first signal terminals 12 and second signal terminals 32 can be avoided respectively.

Figure 4:
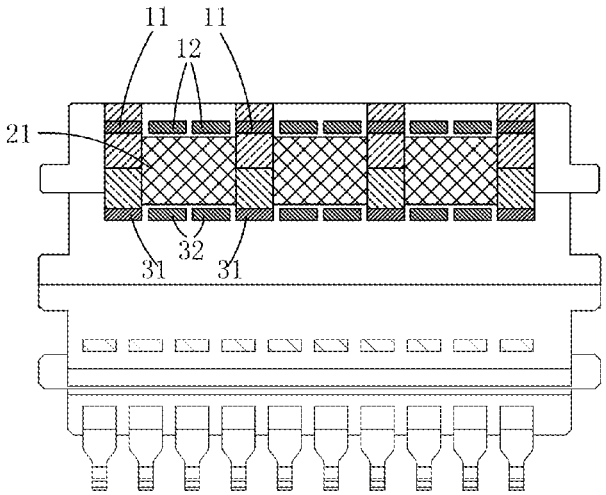
FIG. 4 is a cross-sectional view of a terminal assembly of another embodiment of the present disclosure.

FIG. 4 is a cross-sectional view of a terminal assembly of another embodiment of the present disclosure. As shown in the figure, a part of the embodiment is identical to the embodiment shown in FIG. 3, so the same symbols would be given to the same components and further descriptions would be omitted. The difference between this embodiment and the embodiment shown in FIG. 3 is that the first electric conductors 21 of the electric conductive part 20 in this embodiment are disposed separately. That is, the electric conductive part 20 of this embodiment does not comprise the second electric conductor connected to the first electric conductor 21.

Figure 5:
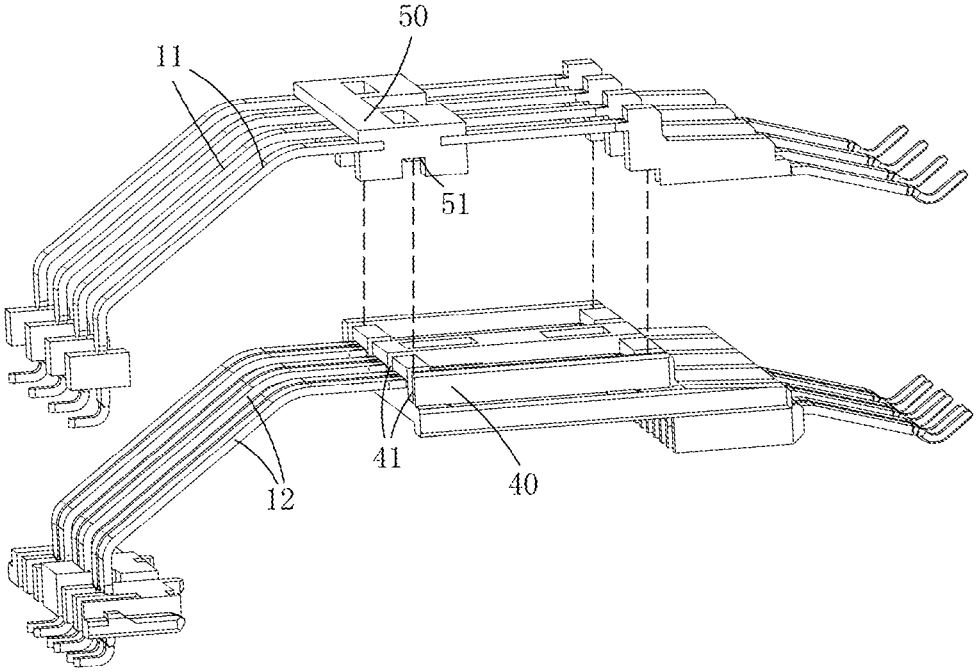
FIG. 5 is an exploded view of the first terminal module of the terminal assembly in FIG. 1.

FIG. 5 is an exploded view of the first terminal module of the terminal assembly in FIG. 1. As shown in the figure, the terminal assembly 100 of one embodiment of the present application further comprises a first signal insulation holding part 40 and a first ground insulation holding part 50. A plurality of first signal terminals 12 is secured on the first signal insulation holding part 40. A plurality of first ground terminals 11 is secured on the first ground insulation holding part 50. The first ground insulation holding part 50 is assembled to the first signal insulation holding part 40. The first signal insulation holding part 40 is secured to the plurality of first signal terminals 12 by insert molding. The first ground insulation holding part 50 is also secured to the plurality of first ground terminals 11 by insert molding. The first signal insulation holding part 40 comprises a plurality of slots 41. The first ground insulation holding part 50 comprises a plurality of protrusions 51. By inserting the plurality of protrusions 51 of the first ground insulation holding part 50 into corresponding plurality of slots 41 of the first signal insulation holding part 40, the first ground insulation holding part 50 is assembled to the first signal insulation holding part 40. In this way, providing a first ground terminal 11 between two pairs of adjacent first signal terminals 12 can be achieved.

Back to FIG. 3, the gap between each first electric conductor 21 and the at least one corresponding first signal terminal 12 is an air gap. As described above, the surface S1 of the first electric conductor 21 is disposed opposite to the surface S2 of the first signal terminal 12. Since no filler is between the surface S1 of the first electric conductor 21 and the surface S2 of a signal terminal 12, the gap is an air gap.

In another embodiment, the terminal structure of the present application further comprises a plurality of insulation parts disposed on each first electric conductor 21 and at least one corresponding first signal terminal 12. The insulation part could cover the at least one corresponding first signal terminal 12. For example, the insulation part may be the first signal insulation holding part 40 as described above. In another embodiment, the insulation part covers the first electric conductor 21. The electric conductive part 20 is a solid metal piece. The insulation part is an insulation material covered on the outside of the solid metal piece. For example, the solid metal piece is covered with plastic. In another embodiment, the electric conductive part 20 comprises an insulation block and a metal layer covering an outer surface of the insulation block. The configuration in which the electric conductive part 20 is covered with an insulation block by the metal layer can also function as a shield. The inner part of the electric conductive part 20 is an insulation block, which could cut down the amount of metal material and reduce the weight compared with solid metal piece as the inner part of the electric conductive part 20. The material of the electric conductive part 20 may also be an electrically lossy material with a wave absorbing function, such as a conductive plastic.

In summary, the present disclosure proposed a terminal assembly in which the electric conductive part 20 is distancing from both the first signal terminal 12 and the first ground terminal 11 while the first signal terminal 12 is closer to the electric conductive part 20 than the first ground terminal 11 so that the electromagnetic waves generated by the first signal terminal 12 could be absorbed or shielded by the electric conductive part 20.

It is to be understood that the term "comprises", "comprising", or any other variants thereof, is intended to encompass a non-exclusive inclusion, such that a process, method, article, or device of a series of elements not only include those elements but also includes other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A terminal assembly, comprising:

a first terminal module, comprising a plurality of first ground terminals and a plurality of first signal terminals, wherein the at least one first signal terminals is provided between two adjacent first ground terminals;

an electric conductive part disposed on the first terminal module, wherein the plurality of first signal terminals are closer to a surface of the electric conductive part than the plurality of first ground terminals, and the electric conductive part is close to but not contact with the first signal terminals of the first terminal module; and a second terminal module, comprising a plurality of second ground terminals and a plurality of second signal terminals, wherein at least one of the plurality of second signal terminals is provided between two adjacent second ground terminals, the second terminal module is disposed on the first terminal module, the plurality of second ground terminals is opposite to the plurality of first ground terminals, and the plurality of second signal terminals is opposite to the plurality of first signal terminals;

wherein the electric conductive part comprises a plurality of first electric conductors and a plurality of second electric conductors; the plurality of first electric conductors are disposed at intervals; each of the plurality of first electric conductors is disposed between the at least one first signal terminal and the at least one second signal terminal opposite to the first signal terminals; the first ground terminals and the plurality of second ground terminals opposite to the plurality of first ground terminals correspond to an interval between two adjacent first electric conductors; two ends of the at least one second electric conductor is connected to two adjacent first electric conductors; and each of the second electric conductors is disposed between the first ground terminals and the second ground terminals opposite to the first ground terminals.

2. The terminal according to claim 1, wherein two first signal terminals are provided between two adjacent first ground terminals.

3. The terminal according to claim 1, wherein the electric conductive part is disposed between the first terminal module and the second terminal module; the plurality of second signal terminals is closer to the electric conductive part than the plurality of second ground terminals but does not contact the surface of the second terminal module.

4. The terminal according to claim 1, wherein the distance between a surface of the second electric conductors close to the first ground terminals and the first ground terminals is greater than the distance between a surface of the first electric conductors close to the first signal terminals and the first signal terminals.

5. The terminal according to claim 2 further comprising a plurality of insulation parts provided in a gap between each of the first electric conductors and the at least one corresponding first signal terminal.

6. The terminal according to claim 5, wherein each of the insulation parts covers the at least one corresponding first signal terminals.

7. The terminal according to claim 5, wherein each of the insulation parts covers the first electric conductors.

8. The terminal according to claim 1, wherein the gap between each of the first electrical conductors and the at least one corresponding first signal terminals is an air gap.

9. The terminal according to claim 1, wherein the electric conductive part is a solid metal piece.

10. The terminal according to claim 1, wherein the electric conductive part comprises an insulation block and a metal layer covering an outer surface of the insulation block.

11. The terminal according to claim 1, wherein the electric conductive part is made of electrically lossy materials.

12. The terminal according to claim 1, wherein the first terminal module further comprises a first signal insulation holding part and a first ground insulation holding part; the plurality of first signal terminals is disposed in the first signal insulation holding part; the plurality of first ground terminals is disposed in the first ground insulation holding part; the first ground insulation holding part is assembled to the first signal insulation holding part.

* * * * *